US009835980B2

(12) United States Patent
Daniels et al.

(10) Patent No.: US 9,835,980 B2
(45) Date of Patent: Dec. 5, 2017

(54) TONER CARTRIDGE CONTAINER AND SEAL

(71) Applicant: Static Control Components, Inc., Sanford, NC (US)

(72) Inventors: Stephen Joseph Daniels, Sanford, NC (US); Robert Farmer, Hope Mills, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 15/091,184

(22) Filed: Apr. 5, 2016

(65) Prior Publication Data

US 2016/0306298 A1 Oct. 20, 2016

Related U.S. Application Data

(60) Provisional application No. 62/150,005, filed on Apr. 20, 2015.

(51) Int. Cl.
*G03G 15/08* (2006.01)

(52) U.S. Cl.
CPC ..... *G03G 15/0894* (2013.01); *G03G 15/0884* (2013.01)

(58) Field of Classification Search
CPC ..... G03G 15/0832; G03G 15/0841
See application file for complete search history.

(56) References Cited

U.S. PATENT DOCUMENTS

| | | | | |
|---|---|---|---|---|
| 5,392,963 | A * | 2/1995 | Kelly | G03G 15/0894 222/325 |
| 5,404,212 | A * | 4/1995 | Ditomaso | G03G 15/0894 222/DIG. 1 |
| 6,272,300 | B1 | 8/2001 | Fujiwara et al. | |
| 6,925,273 | B1 | 8/2005 | Michlin et al. | |
| 2003/0170045 | A1 | 9/2003 | Lewis et al. | |
| 2004/0197120 | A1 | 10/2004 | Yanagisawa et al. | |
| 2006/0088334 | A1 | 4/2006 | Martin | |
| 2009/0003873 | A1 | 1/2009 | Martinez | |
| 2009/0285604 | A1 | 11/2009 | Nakajima | |

* cited by examiner

*Primary Examiner* — Victor Verbitsky

(57) ABSTRACT

A method of remanufacturing an imaging cartridge comprising a toner hopper having a toner bag and not having a seal port, the method comprising forming a seal port in the toner hopper; disposing a replacement toner container in the toner hopper, the replacement toner container including a removable seal having a seal tail; and inserting a portion of the seal tail through the seal port. A method of remanufacturing an imaging cartridge comprising a toner hopper having a toner bag and not having a seal port, the method comprising providing a replacement toner hopper having a seal port; removing the toner hopper not having the seal port from the imaging cartridge; and attaching the replacement toner hopper having a seal port to the imaging cartridge.

4 Claims, 10 Drawing Sheets

TONER CARTRIDGE CONTAINER AND SEAL

The present application claims the benefit of U.S. Provisional Patent Application Ser. No. 62/150,005 filed Apr. 20, 2015 which is incorporated by reference herein in its entirety.

BACKGROUND

The present invention generally relates to toner containers, seals, and the like, and more particularly to a toner container which holds toner in a printer toner cartridge or the like.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, and facsimile machines, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Imaging cartridges include one or more compartments holding the marking material which is deposited on a surface, such as paper. For a laser toner cartridge, this compartment may be referred to as the toner hopper.

Cartridge seals prevent toner from leaking out of the toner cartridge during shipping and handling. Cartridge seals are removed either by the end user or automatically by the printer prior to printing. During remanufacturing of a cartridge it is necessary to replace the cartridge seal so that the cartridge can once again be shipped without the fear of toner leaking out of the cartridge. The HP M252/277 (201A/201X cartridge) contains a sealed bag filled with toner. The seal is attached to the bag by some method of heat and the tail end of the seal is attached to the tone agitator shaft that runs through the cartridge. Once the cartridge is installed into the printer the printer engages a drive gear that is attached to agitator shaft and removes the seal from the bag. The seal then acts as a toner agitator paddle for the remainder of the toner life.

SUMMARY

In one aspect of the present invention, advantageous methods and apparatus for sealing toner within a toner cartridge, such as the HP M252/277 (201A/201X) cartridge, during the original manufacturing or remanufacturing process are provided.

A method of remanufacturing an imaging cartridge comprising a toner hopper having a toner bag and not having a seal port, the method comprising forming a seal port in the toner hopper; disposing a replacement toner container in the toner hopper, the replacement toner container including a removable seal having a seal tail; and inserting a portion of the seal tail through the seal port.

A method of remanufacturing an imaging cartridge comprising a toner hopper having a toner bag and not having a seal port, the method comprising providing a replacement toner hopper having a seal port; removing the toner hopper not having the seal port from the imaging cartridge; and attaching the replacement toner hopper having a seal port to the imaging cartridge.

A replacement toner container may be attached to the replacement toner hopper, and the replacement toner container may include a removable seal having a seal tail, the seal tail extending through the seal port.

The replacement toner hopper may include an integrated enclosure holding toner and a removable seal disposed over a port opening of the integrated enclosure holding toner, and wherein the removable seal includes a seal tail extending from the seal port.

A more complete understanding of the present invention, as well as further features and advantages of the invention, will be apparent from the following detailed description and the accompanying drawings.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The following detailed description of preferred embodiments refers to the accompanying drawings, which illustrate specific embodiments of the invention. In the discussion that follows, specific systems and techniques for repairing, manufacturing, or remanufacturing an imaging cartridge, such as a toner cartridge, are described. Other embodiments having different structures and operations for the repair, remanufacture, and operation of other types of replaceable imaging components and for various types of imaging devices, such as laser printers, inkjet printers, copiers, facsimile machines and the like, do not depart from the scope of the present invention.

Figure 1:
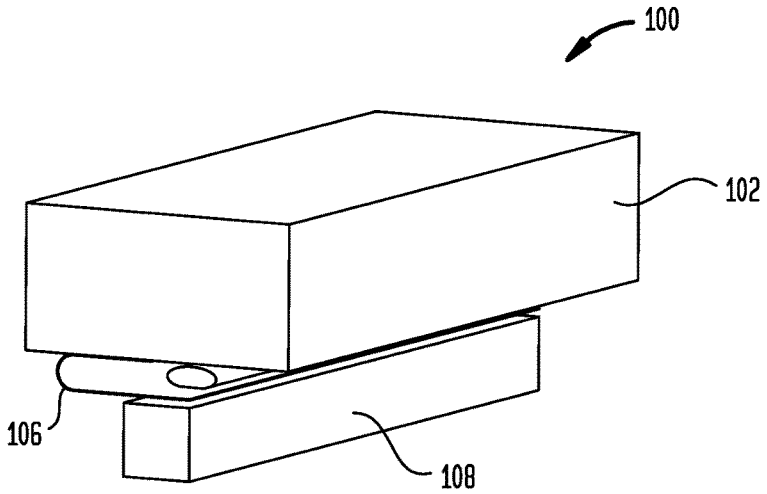
FIG. 1 shows an isometric view of a toner bag, toner bag seal and agitator in accordance with aspects of multiple embodiments the present invention.
Figure 2:
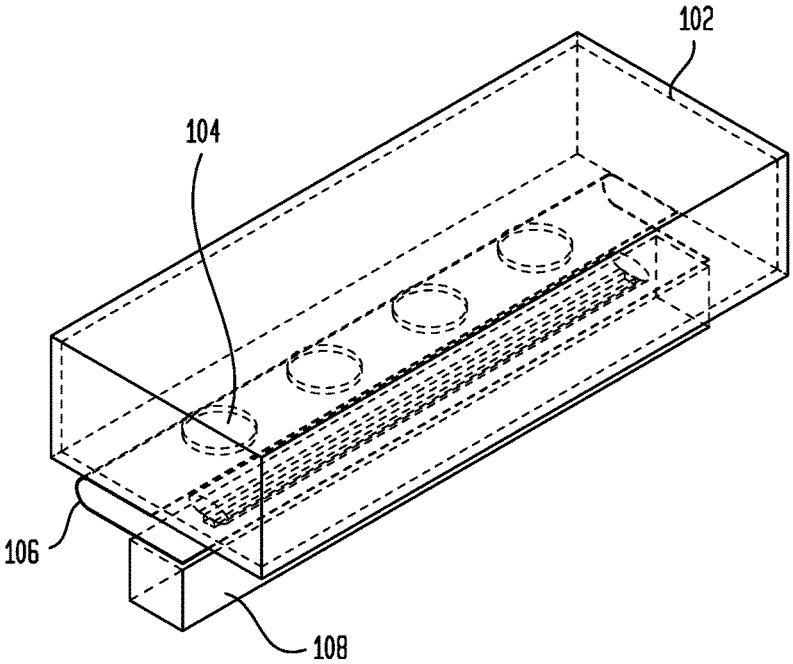
FIG. 2 shows an isometric view of a toner bag, toner bag seal and agitator in accordance with aspects of multiple embodiments the present invention.
Figure 3:
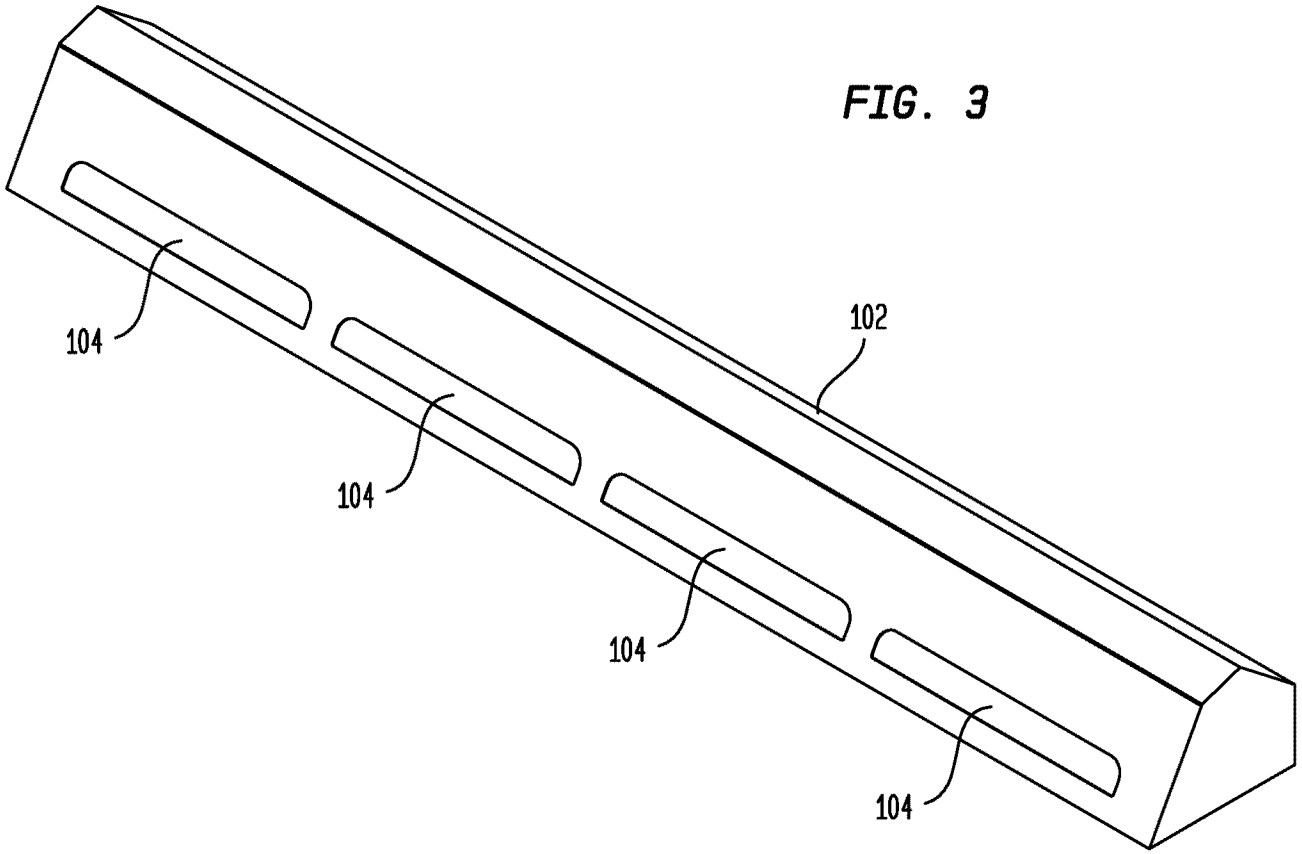
FIG. 3 shows a toner replacement bag in accordance with aspects of the present invention.
Figure 4:
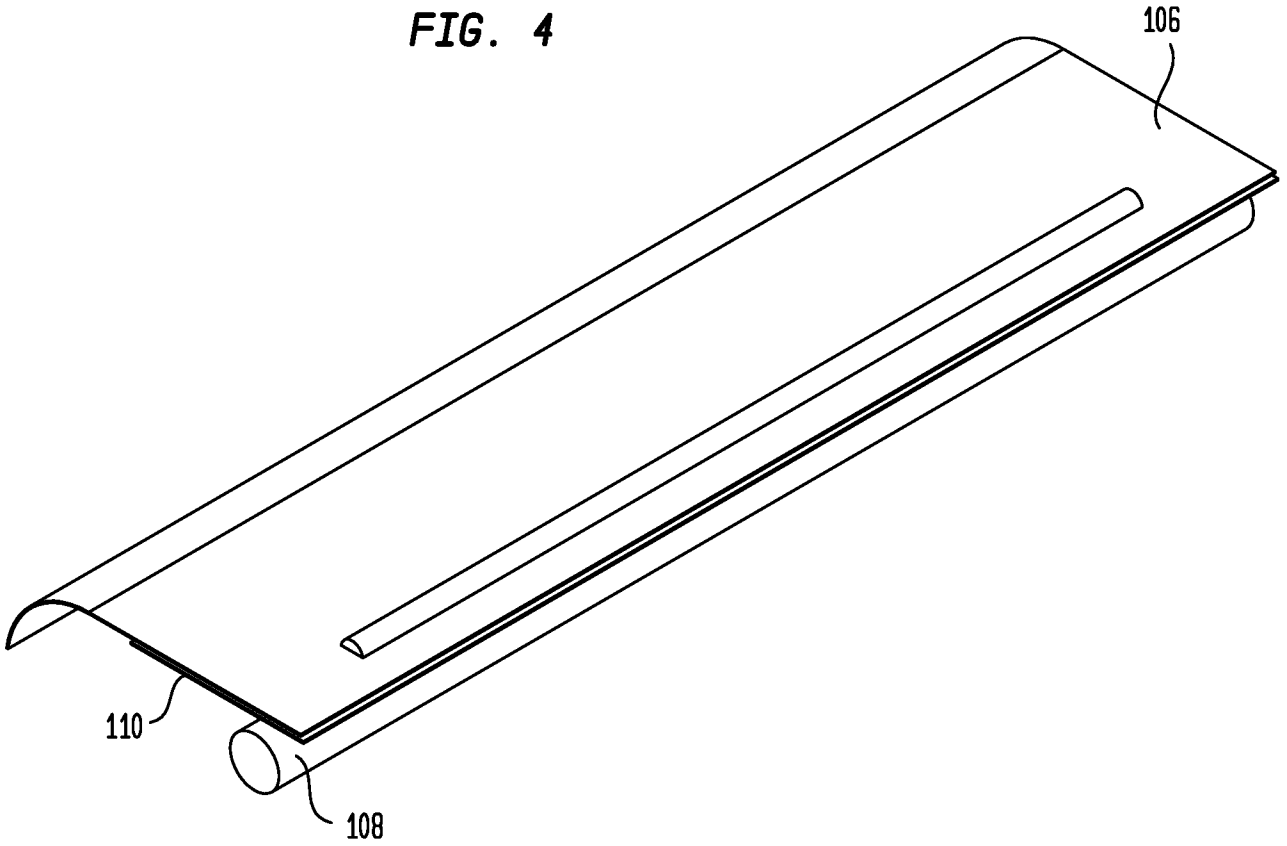
FIG. 4 shows a toner bag seal and agitator in accordance with aspects of the present invention.

FIGS. 1 and 2 show views of a remanufactured or replacement assembly 100 in accordance with one aspect of the present invention. The assembly 100 may be suitably disposed in a toner hopper of toner cartridge and may include a toner container 102 (also referred to as a toner bag) holding toner and having toner exit ports 104. The toner exit ports 104 may be covered and sealed by one end of a seal 106. Another end of the seal 106 may be attached to an agitator shaft 108. As seen in FIG. 4, an agitator blade 110 may also be attached to the agitator shaft 108. Once the printer begins rotating the agitator shaft 108, the seal 106 will be pulled thus opening the port on the bag and allowing toner to flow freely to the developing components. FIG. 3 shows another view of the toner container 102 with toner exit ports 104.

In one aspect, during the remanufacturing process, at least a portion of the components of the assembly 100 may be reused. The original equipment manufacturer (OEM) toner bag and seal can be reused to seal the toner within the cartridge. The OEM bag can be removed from the hopper or left in place during this process. The OEM bag may be cleaned out thoroughly to remove any residual toner. The OEM seal can be reapplied to the OEM toner bag using, for example, adhesive, glue, or a heat method such as heat stake or ultrasonic welding. Toner can either be filled into the bag using the existing toner port prior to applying the seal or a small slit can be made in the bag to add toner. If a small slit is made then it can be sealed by, for example, adhesive, glue, or a heat method.

In one aspect, the OEM bag and seal can be reused to seal the toner within the cartridge. The OEM bag can be removed from the hopper or left in place during this process. The OEM bag may be cleaned out thoroughly to remove any residual toner. The OEM seal can be trimmed to remove the portion where the seal was originally applied to the bag. A new never used portion of the OEM seal can then be applied to the OEM bag using, for example, adhesive, glue, or a heat method such as heat stake or ultrasonic welding. Toner can either be filled into the bag using the existing toner port prior to applying the seal or a small slit can be made in the bag to add toner. If a small slit is made then it can be sealed either by adhesive, glue, or a heat method, for example.

According to another aspect, a new toner bag 102 and new removable seal 106 can be used to seal the toner within the cartridge. The toner bag 102 can be made out of, for example, plastic, foil, or any other suitable flexible material. At least a portion of the toner bag 102 may comprise an air permeable material, such as a polymer microfiber blend, for example. A portion of the bag may comprise a rigid material, such as high impact polystyrene (HIPS). The toner bag 102 can have a toner port 104 or slit for adding toner to the toner bag 102. The toner port 104 or slit can be sealed by, for example, a screw on cap, plug, adhesive, glue, or heat method such as heat stake or ultrasonic welding. The seal 106 can be either integrated into the bag 102 or can be attached to the outer portion of the bag 102 via, for example, adhesive, glue, or heat method. The end of the seal 106 can be attached to the agitator shaft 108. Depending on the shape of the seal 106 it can become a toner agitator paddle or the ribbon or pull strip can be coiled/wrapped around the agitator 108 and serve no further purpose.

In another aspect, toner can be filled directly into the toner hopper. The OEM used bag and seal can remain in their current positions. The developing components within the toner cartridge all contact each other therefore providing a seal or barrier that prevents toner from leaking out of the cartridge.

In another aspect, toner can be filled directly into the OEM toner bag located within the hopper without any disassembly required. This will allow toner to enter the hopper without being impeded by the OEM used bag. The OEM used bag, agitator, and seal can remain in their current positions. The toner can be filled into the bag through a hole placed through both the surface of the hopper and the bag. The hole can be created via drilling or heated tooling. The hole can be sealed with, for example, a plug or adhesive backed seal. The developing components within the toner cartridge all contact each other therefore providing a seal or barrier that prevents toner from leaking out of the cartridge.

In another aspect, the toner container 102 may comprise a hard casing within the cartridge. The toner casing 102 can be made of, for example, plastic, metal, or any other suitable rigid material. Toner can be filled into the casing through the toner port prior to installing a seal or through a separate port that can be sealed using, for example, a screw on cap, plug, adhesive, glue, or heat method. A removable seal can be attached to the outer portion of the casing via adhesive, glue, or heat method. The end of the seal can be attached to the agitator shaft. Once the printer begins rotating, the agitator the seal will be pulled thus opening the port on the casing and allowing toner to flow freely to the developing components. Depending on the shape or design of the seal it can become a toner agitator paddle or the ribbon or pull strip can be coiled/wrapped around the agitator and serve no further purpose.

Figure 5:
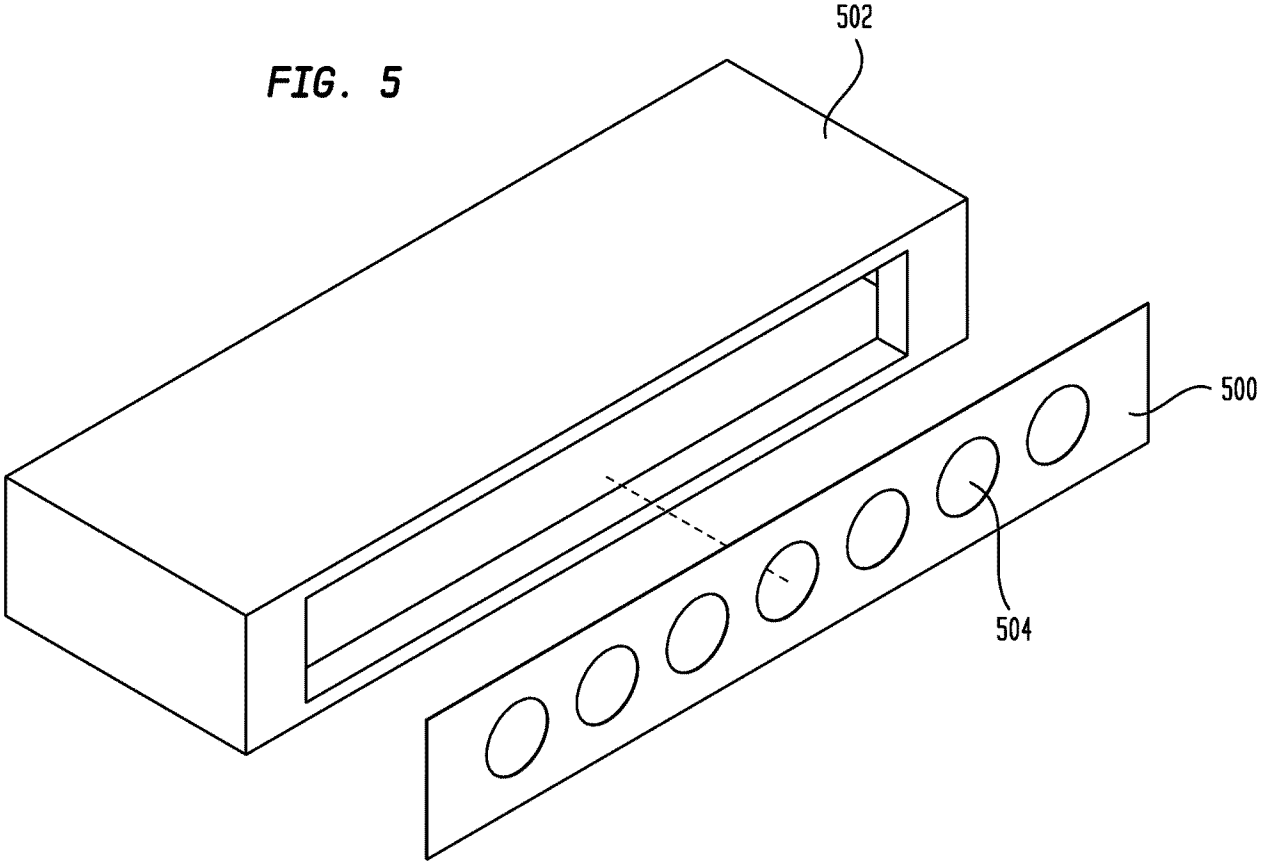
FIG. 5 shows a view of a toner hopper portion and port barrier in accordance with the present invention.

In another aspect, as seen in FIG. 5, a barrier 500 with port holes 504 can be added within a toner hopper or toner hopper portion 502. The barrier 500 may be placed between the developing components and the agitator shaft 108 within the hopper 502. The barrier 500 can be made of, for example, plastic, metal, or any other suitable material. The barrier 500 may be attached to the hopper 502 using adhesive, glue or a heat method. A seal, such as the seals 106, 106*a*, or 106*b* described herein, can be attached to the inner or outer portion of the barrier 500 via adhesive, glue, heat or other suitable method. If the seal is attached to the inner portion (closest to the agitator shaft) of the barrier 500 then the end of the seal can be attached to the agitator shaft. Once the printer begins rotating the agitator the seal will be pulled thus opening the port on the barrier and allowing toner to flow freely to the developing components. The seal can become a toner agitator paddle or the ribbon or pull strip can be coiled/wrapped around the agitator and serve no further purpose. If the seal is attached to the outer portion (closest to the developing components) of the barrier 500 then the seal will need to be pulled manually by the end user. To allow the end user to pull the seal manually an opening will need to be formed in the hopper using, for example, a blade or rotary tool to feed the end of the seal out of the hopper. With the end of the seal extending out of the hopper the end user can now pull the seal prior to installing the cartridge into the printer thus opening the port on the barrier and allowing toner to flow freely to the developing components.

Figure 6:
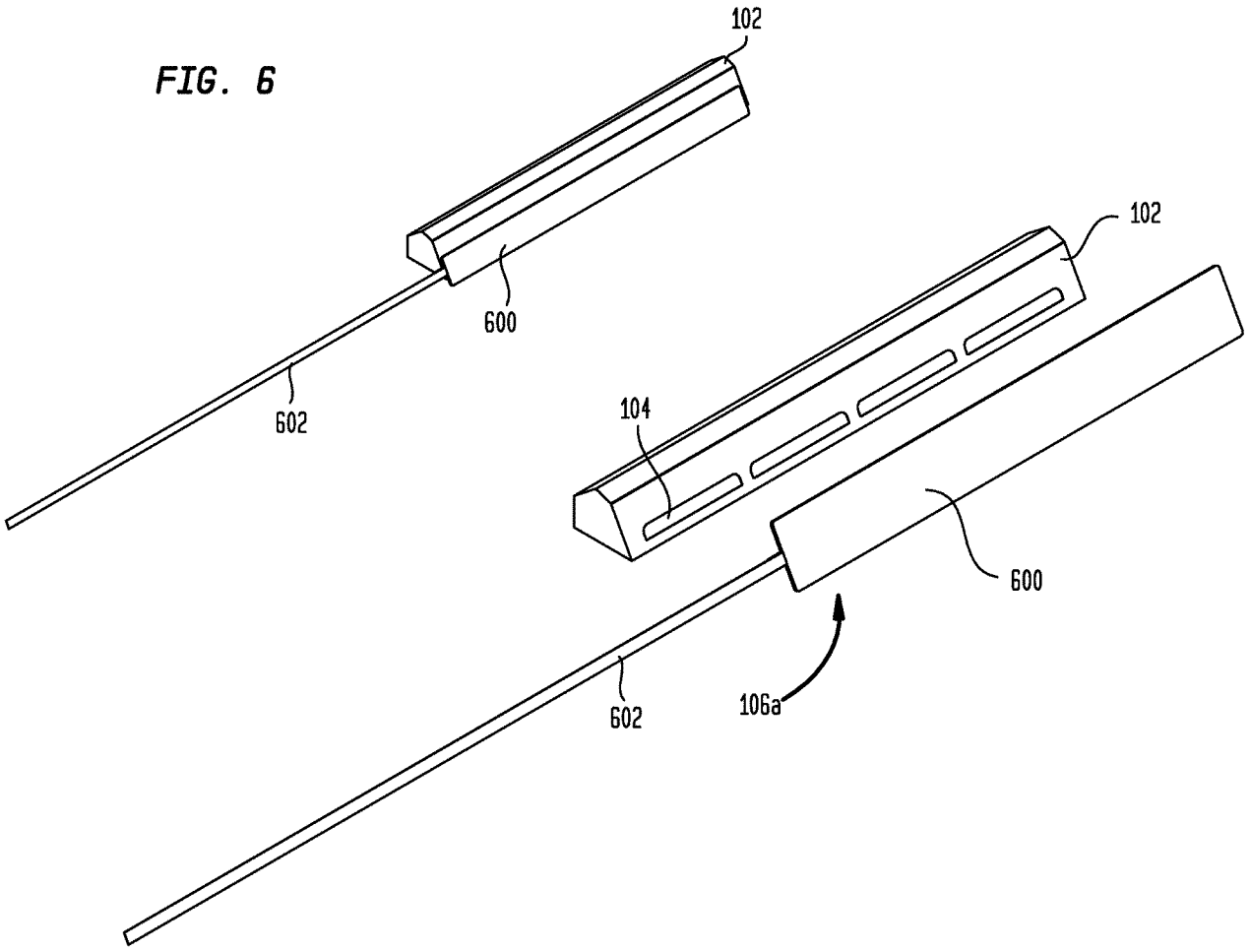
FIG. 6 shows a toner container and pull seal in accordance with the present invention.

In another aspect, a new toner bag 102 and a removable seal 106*a* can be used to seal the toner within the cartridge. FIG. 6 shows the removable seal 106*a* comprising a seal body 600 and a seal tail 602 which is pulled by the end user. The seal body 600 may comprise, for example, a flexible or semi-flexible body made of plastic or other suitable material with a plastic, polymer coated fiber or other suitable material attached using adhesive, heat or other methods. The bag 102 can be made out of materials including plastic, foil, a hard casing or any other suitable material. The bag 102 can be installed within the toner hopper and attached to the cartridge by any suitable method such as adhesive, glue, or a heat method, for example. The bag 102 can have ports 104 or another opening for adding toner to the bag 102. The seal 106*a* can be either integrated into the bag 102 or can be attached to the outer portion of the bag 102 via adhesive, glue, or heat method, for example, as seen in FIG. 6. The seal tail 602 can be pulled manually by the end user prior to printing to allow toner to exit the toner bag 102.

Figures 7, 8:
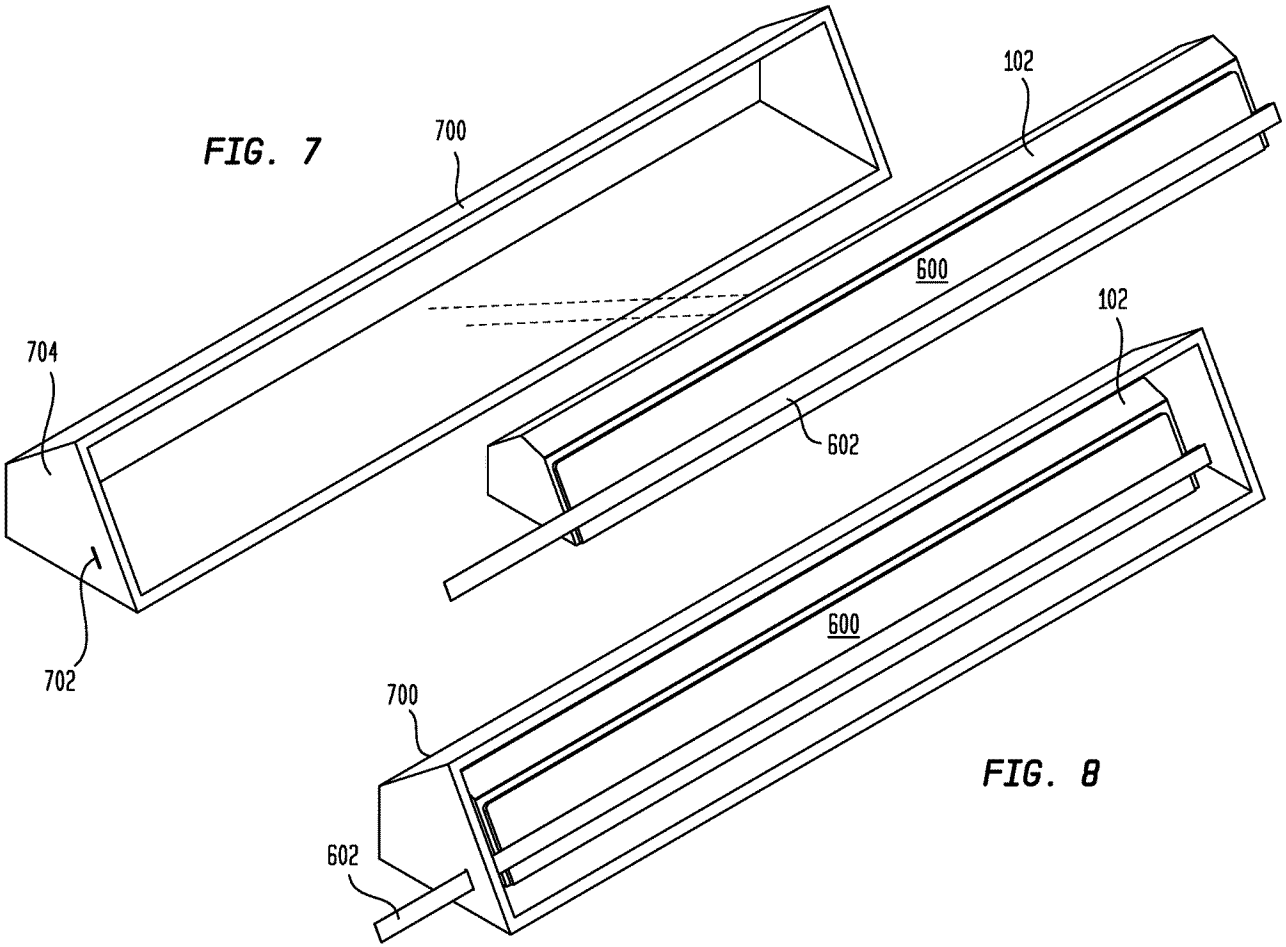
FIGS. 7 and 8 show a toner hopper, toner container and pull seal in accordance with the present invention.

As shown in FIG. 7, to allow the end user to pull the seal tail 602 manually, a seal port 702 can be formed in the toner hopper 700 to feed the end of the seal tail 602 out of the hopper 700. The seal port 702 may be formed through conventional cutting methods or other techniques. Alternatively, the seal tail 602 can be fed through an existing opening in the toner hopper 700. Alternatively, a new toner hopper 700 may be provided with the seal port 702 to replace the original hopper lacking a seal port. Alternatively, an end cap or other portion of the original toner hopper 700 may be replaced an end cap 704 having the seal port 702.

With the end of the seal tail 602 extending out the seal port 702 the end user can now pull the seal tail 602 prior to installing the cartridge into the printer, thus removing a portion of the seal body 600 covering the toner exit ports 104 and allowing toner to flow freely to the developing components. FIG. 8 shows a view of a toner hopper 700 with the seal tail 602 extending from an opening 702 in the hopper and the bag 102 installed within the hopper 700.

Figure 9:
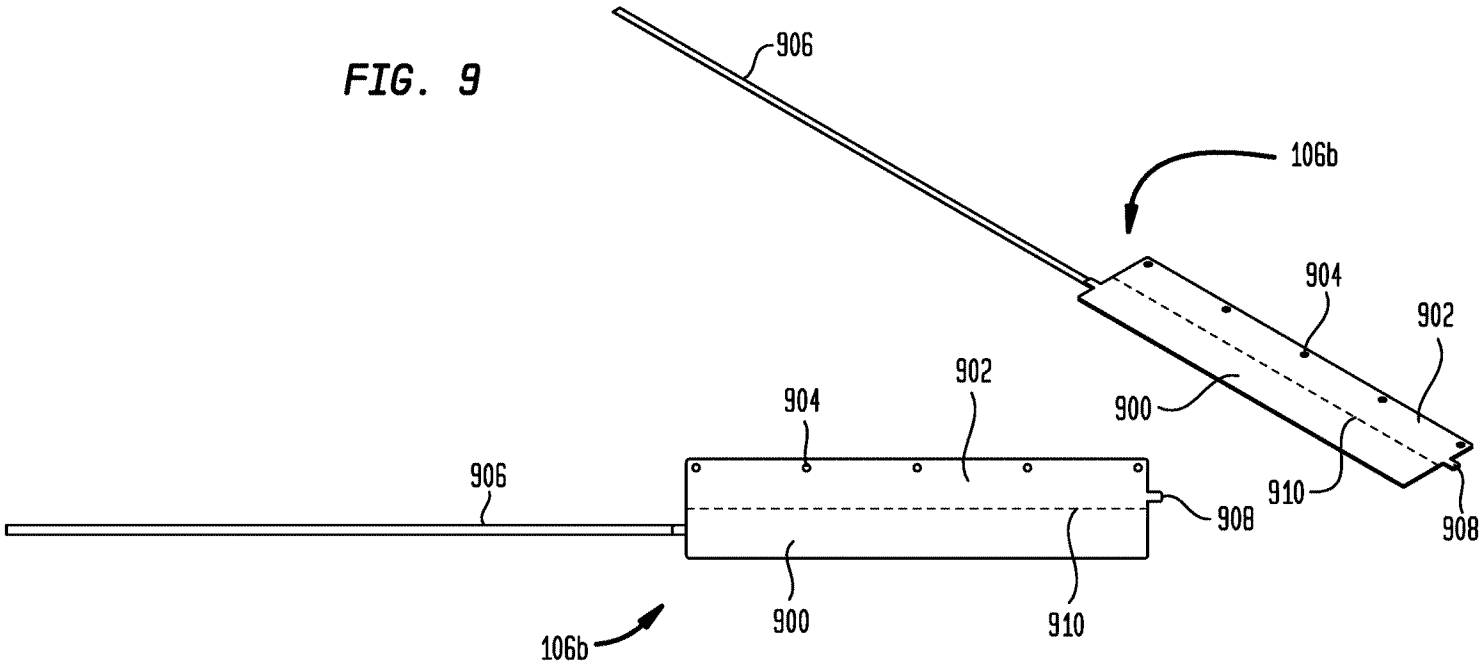
FIG. 9 shows a dual use seal in accordance with the present invention.

In another aspect, FIG. 9 shows views of a dual use seal 106*b* which can be attached to and removed the agitator shaft 108 or removed by the end user through a slot in the cartridge. A seal body 900 includes a removable portion 902 adapted for attachment to the agitator shaft 108. Holes 904 may be attached to posts of the agitator shaft 108. If attached to the agitator shaft 108, a seal tail 906 may be removed, forming a seal similar to the seal 106. If the seal 106*b* is to be removed by an end user, the portion 902 may be removed, forming a seal similar to 106*a*. In one embodiment the removable portion 902 may be torn away along line 910 using a tab 908 to cause the material of the seal to tear. The seal 106*b* may comprise, for example, a flexible or semi-flexible body made of plastic or other suitable material with a plastic, polymer coated fiber or other suitable material attached using adhesive, heat or other methods.

Figure 10:
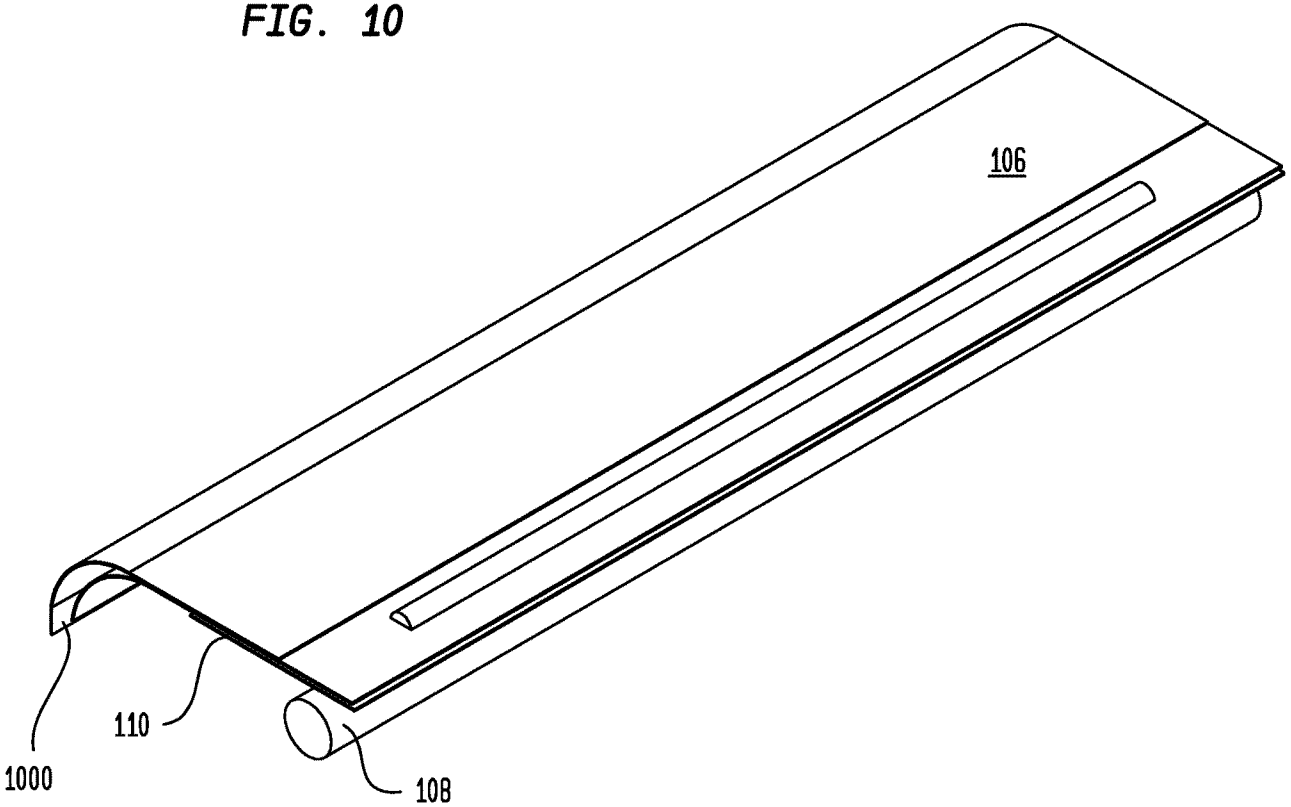
FIG. 10 shows a new seal attached to an original OEM seal in accordance with the present invention.

In another aspect, a new bag and removable seal can be used to seal the toner within the cartridge. The bag can be made out of plastic, foil, or any other suitable flexible material. The new bag can be installed within the cartridge using adhesive, glue, heat, or other suitable method. The bag may have a port or slit for adding toner to the bag. The port or slit can be sealed by a screw on cap, plug, adhesive, glue, or heat method such as heat stake or ultrasonic welding. A seal 1000 can be either integrated into the bag or can be attached to the outer portion of the bag via adhesive, glue, or heat method. As seen in FIG. 10, the seal 1000 can be attached to the original OEM seal 106 which is still attached to the agitator shaft. Once the printer begins rotating the agitator 108, the OEM seal 106 will pull the seal 100 that is attached to or incorporated into the toner bag 102 thus opening the port on the bag and allowing toner to flow freely to the developing components. The seal that is removed from the bag will remain attached to the OEM seal and become an agitator paddle within the hopper.

Figure 11:
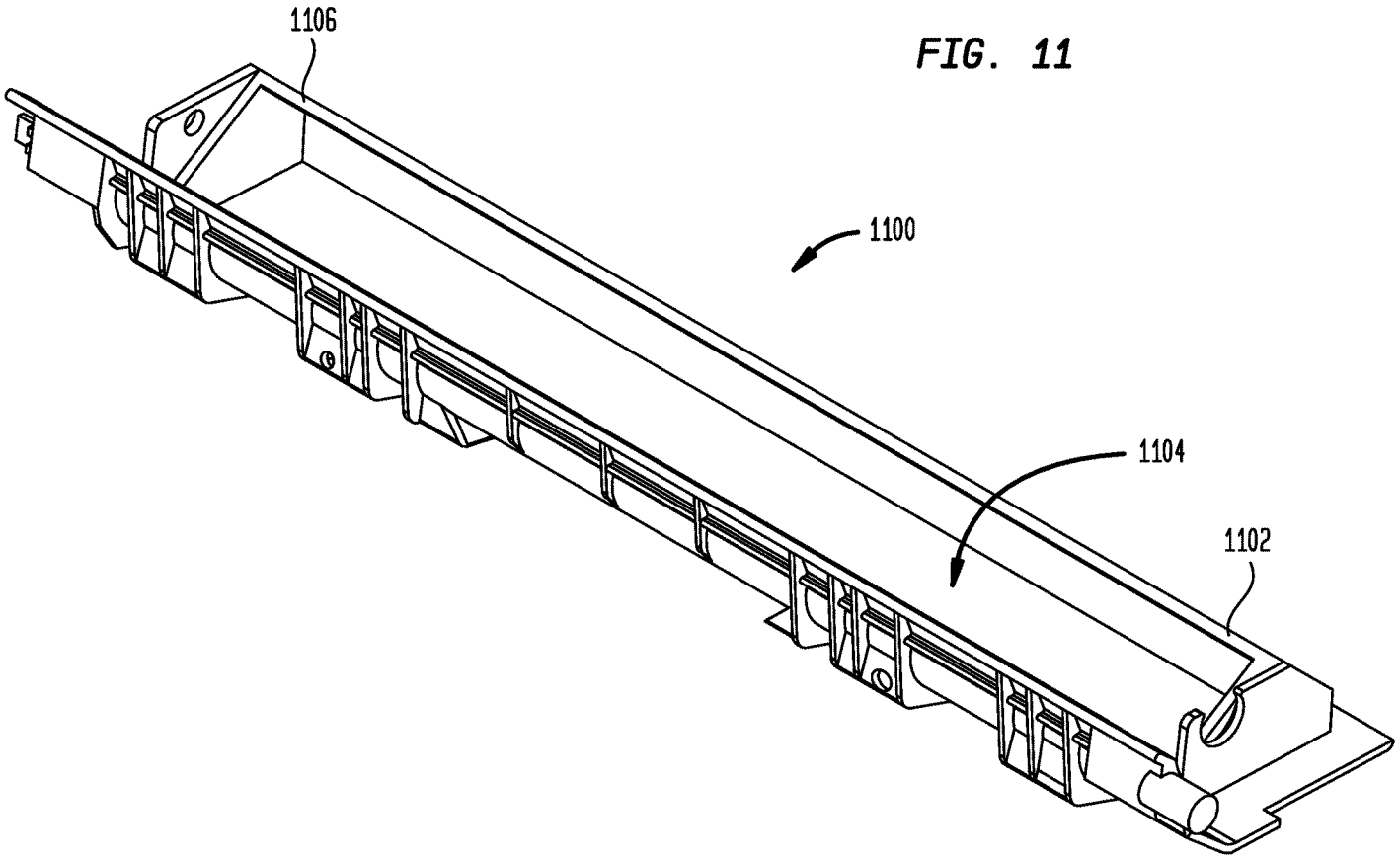
FIG. 11 shows a new portion of a toner hopper with an integrated enclosure in accordance with the present invention.

In another, as seen in FIG. 11, a new hopper section 1100 with an integrated enclosure 1102 for holding the toner can be used. An OEM toner hopper may comprise two or more sections that are sonically welded together. Once the OEM hopper has been split into two sections, either one of the two OEM hopper sections can be pared with a brand new molded hopper section. The new molded hopper section 1100 can have an enclosure 1102 that can contain the toner. The new hopper section 1100 and enclosure 1102 may be molded as a single piece out of plastic. The enclosure 1102 that is built into the hopper section can have one or more port openings 1104 to install the toner. A seal, such as seal 106, seal 106*a* or seal 106*b*, can be attached to a surface 1106 of the enclosure 1102 over the port openings 1104. Once toner is sealed within the enclosure 1102 of the new hopper section 1100 it can then be mated with the opposite OEM section to make a whole hopper. When the cartridge is ready to be used the seal can either be removed from the enclosure manually by the end user or can be removed automatically by the printer depending on the design of the seal. Toner will then be free to flow from the enclosure and to the developing components.

Figure 12:
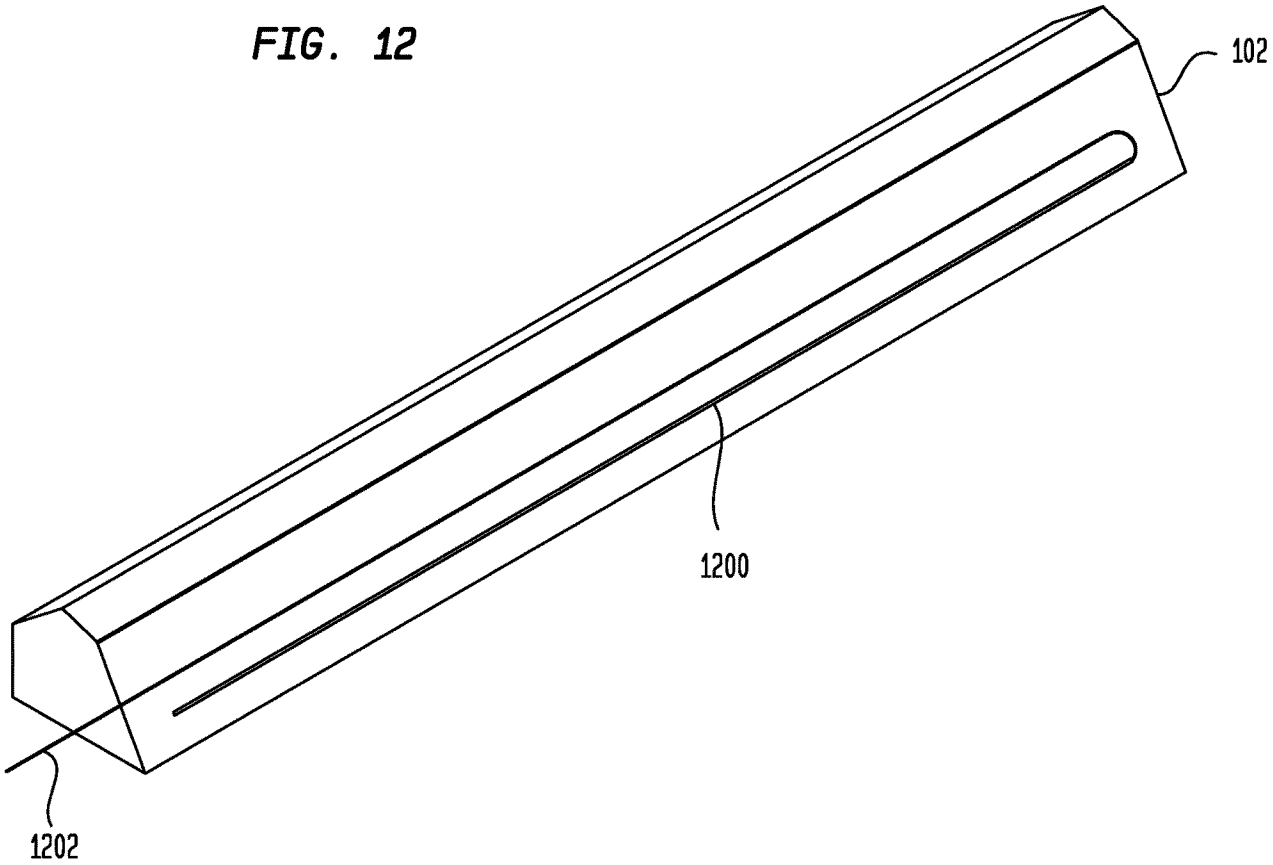
FIG. 12 shows a toner container the bag 102 with an interlocking seal 1200 can be used to contain the toner within the cartridge.

In another aspect, as seen in FIG. 12, the bag 102 with an interlocking seal 1200 can be used to contain the toner within the cartridge. The bag 102 can be made out of plastic, foil, or other suitable material. The bag 102 can be installed within the cartridge using adhesive, glue, heat or other suitable method. Toner can also be added to the bag through the opening of the interlocking seal port 1200 before it is closed. The interlocking seal port 1200 can be comprised of two halves of the bag that lock together through some locking method. An example would be a zip lock bag or a zipper on a jacket. Locking the two halves together would seal the toner within the bag. A pull string or ribbon 1202 can be attached to the zipper on the bag. The string or ribbon 1202 can be fed through a hole or slot on the hopper. The end user can manually pull on the string or ribbon 1202 prior to installing the cartridge into the printer which will open up the interlocking port 1200 on the bag 102 and allowing toner to flow freely to the developing components. The end of the string/ribbon can also be attached to the agitator shaft 108. When the cartridge is installed into the printer the agitator will spin which will automatically pull the string/ribbon and open the interlocking port of the bag allowing toner to flow freely to the developing components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A dual-use toner hopper seal comprising:

a seal body comprising a removable portion;

a removable seal tail attached to the seal body; and a tab attached to the removable portion to tear and remove the removable portion from the seal body along a line in a longitudinal direction of the seal body, wherein when the removable portion is removed from the seal body, the seal body is removable by an end user through a slot in a toner cartridge;

wherein the removable portion comprises holes for attachment to an agitator shaft of the toner cartridge, and wherein when the seal tail is removed from the seal body and the removable portion is attached to the agitator shaft along the longitudinal direction of the seal body, the seal body is removable by rotating the agitator shaft by a printer.

2. The dual-use toner hopper seal of claim 1 wherein the seal body comprises a flexible body.

3. The dual-use toner hopper seal of claim 1 wherein the seal comprises a semi-flexible body.

4. A method of using a dual-use toner hopper seal comprising a seal body and a removable tail, said seal body having a removable portion and a tab attached to the removable portion, the method comprising:

if the dual-use toner hopper seal is to be removed by an agitator shaft of a toner cartridge, then removing the seal tail and attaching the removable portion to the agitator shaft of the toner cartridge; and if the dual-use toner hopper seal is to be removed by an end user pulling the seal tail through a slot in the toner cartridge, then removing the removable portion from the seal body using the tab attached to the removable portion.

* * * * *